US007665512B2

(12) United States Patent
Brost et al.

(10) Patent No.: US 7,665,512 B2
(45) Date of Patent: Feb. 23, 2010

(54) FLAT HEAT EXCHANGER TUBE

(75) Inventors: Viktor Brost, Aichtal (DE); Rainer Käsinger, Haiterback (DE)

(73) Assignee: Modine Manufacturing Company, Racine, WI (US)

( * ) Notice: Subject to any disclaimer, the term of this patent is extended or adjusted under 35 U.S.C. 154(b) by 231 days.

(21) Appl. No.: 10/865,291

(22) Filed: Jun. 9, 2004

(65) Prior Publication Data

US 2005/0006082 A1 Jan. 13, 2005

(30) Foreign Application Priority Data

Jun. 21, 2003 (DE) ..... 103 28 001

(51) Int. Cl.
*F28F 9/04* (2006.01)
*B21D 21/00* (2006.01)
*F28D 1/02* (2006.01)

(52) U.S. Cl. ..... 165/178; 165/177; 29/890.053

(58) Field of Classification Search ..... 165/177, 165/178, 183, 153; 29/890.05, 890.053; 72/368–369
See application file for complete search history.

(56) References Cited

U.S. PATENT DOCUMENTS 5,386,629 A * 2/1995 Ouchi et al. ..... 29/890.046
5,579,837 A 12/1996 Yu et al.
5,890,288 A 4/1999 Rhodes et al.
5,934,365 A 8/1999 Rhodes et al.
5,956,846 A 9/1999 Ross
6,000,461 A * 12/1999 Ross et al. ..... 165/79
6,209,202 B1 4/2001 Rhodes et al.
6,513,582 B2 * 2/2003 Krupa et al. ..... 165/133
2004/0182559 A1 * 9/2004 Kent et al. ..... 165/183

FOREIGN PATENT DOCUMENTS

EP 302232 A * 2/1989
EP 742 418 B1 4/1996
EP 1 074 807 A2 2/2001
EP 1362649 A1 * 11/2003
JP 2001-170713 6/2001
JP 2002130969 A * 5/2002

OTHER PUBLICATIONS

European Search Report dated Oct. 7, 2004.

* cited by examiner

*Primary Examiner*—Tho V Duong
(74) *Attorney, Agent, or Firm*—Michael Best & Friedrich LLP

(57) ABSTRACT

A flat heat exchanger tube formed of a single strip of rolled aluminum, with at least one connection between the two broad sides. The connection is generally parallel to and spaced between the narrow sides and divides the heat exchanger tube into at least two chambers, and includes two legs consisting of bent opposite edges of the aluminum strip, the legs each having a head at adjacent bends along one of the broad sides and feet adjacent the other broad side. The legs lie against each other generally at their head over no more than half of the entire spacing between the two broad sides, with the legs enclosing an angle between them of about 20° to 100° or about 45° to 75°, advantageously 60°.

24 Claims, 4 Drawing Sheets

FLAT HEAT EXCHANGER TUBE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward heat exchanger tubes, and particularly toward flat heat exchanger tubes produced from sheet metal strips.

BACKGROUND OF THE INVENTION AND TECHNICAL PROBLEMS POSED BY THE PRIOR ART

Flat heat exchanger tubes have been produced from sheet metal strips of limited sheet thickness, with two opposite broad sides and two opposite narrow sides, as well as with at least one connection between the two broad sides dividing the heat exchanger tube into at least two chambers. The connection consists of at least two closely adjacent legs formed by small radius bends along the edges of the strip on one broad side, with the legs forming an angle between them. The feet of the legs are secured on the other broad side.

U.S. Pat. No. 6,209,202 B1 discloses flat heat exchanger tubes of this general type in which quite limited bending radii at the head of the legs are prescribed whereby the closely adjacent legs leave only a very small, roughly triangular hole or gap along the length of the outer periphery of the heat exchanger tube, with the heat exchanger tube being later soldered in the opening to close the tube. U.S. Pat. No. 5,934,365 discloses quite specific small diameters for a circle that fits in this hole or gap, and U.S. Pat. No. 5,890,288 discloses (see particularly FIG. 7 thereof) achieving the small bending radii by applying a perpendicular force to the deformed longitudinal edges by using a tool.

Heat exchanger tubes such as disclosed in these patents require deformation of the edge in specific narrow tolerances, requiring that considerable value must be placed on continuous control of the state of the tool being used (e.g., rollers) and its maintenance.

Further, while it is known from, for example, EP 742 418 B1 (FIG. 2) to achieve narrow bending radii by producing plates using drawing dies which reduce the plates in sheet thickness adjacent to the bending radius, such procedures are difficult to apply to heat exchanger tubes which may be produced by rollers from a sheet metal strip, since flat heat exchanger tubes are frequently no wider in their small dimension (between broad sides) than 2.0 mm and the thicknesses of the sheet used may be in the 0.1 mm range.

The present invention is directed toward overcoming one or more of the problems set forth above.

SUMMARY OF THE INVENTION

In one aspect of the present invention, a flat heat exchanger tube is formed of a single strip of rolled aluminum. The tube includes two opposite spaced apart broad sides and two opposite narrow sides and at least one connection between the two broad sides. The connection is generally parallel to and spaced between the narrow sides and divides the heat exchanger tube into at least two chambers, and includes two legs consisting of bent opposite edges of the aluminum strip, the legs each having a head at adjacent bends along one of the broad sides and feet adjacent the other broad side. The legs lie against each other generally at their head over no more than half of the entire spacing between the two broad sides, and the feet define substantially flat surfaces secured to the other broad side.

In one form of this aspect of the present invention, the legs enclose an angle between them of about 20° to 100°. In a further form, the legs enclose an angle between them of about 45° to 75°. In a still further form, the legs enclose an angle between them of about 60° and the legs and the other broad side substantially form an equilateral triangle.

In another form of this aspect of the present invention, the feet are substantially aligned and extend in opposite directions from the legs.

In still another form of this aspect of the present invention, the legs lie against each other generally at their heads over about ⅓ of the spacing between the two broad sides.

In yet another form of this aspect of the present invention, the feet are substantially aligned and extend in opposite directions from the legs.

In another form of this aspect of the present invention, the outside of the heat exchanger tube is solder-coated.

In still another form of this aspect of the present invention, there is at least one additional connection between the broad sides formed by a fold in one or the other of the broad sides, wherein the end of the fold is secured to the broad side opposite the one or the other broad side. In a further form, there are a plurality of the additional connections, with the plurality of additional connections being alternately formed from the one broad side and from the other broad side.

In yet another form of this aspect of the present invention, the inner bending radius of the bent edges at the head of the legs is about 0.2 mm.

In a further form of this aspect of the present invention, the thickness of the aluminum strip at the leg head bends is less than the thickness of adjacent portions of the aluminum strip. In a further form, the strip thickness at the leg head bends is about 40% less than the thickness of the adjacent portions of the aluminum strip.

In yet another form of this aspect of the present invention, a method of producing tubes according to this aspect of the invention are provided by rolling adjacent leg bends to have an inner bending radius below 0.2 mm during production of the leg bends whereby the outer bending radius is minimized from the inside out by material displacement.

In another aspect of the present invention, a flat heat exchanger tube is formed of a single strip of rolled aluminum. The tube includes two opposite spaced apart broad sides and two opposite narrow sides and at least one connection between the two broad sides. The connection is generally parallel to and spaced between the narrow sides and divides the heat exchanger tube into at least two chambers, and includes two legs consisting of bent opposite edges of the aluminum strip, the legs each having a head at adjacent bends along one of the broad sides and feet adjacent the other broad side. The legs lie against each other generally at their head over no more than half of the entire spacing between the two broad sides, and enclose an angle between them of about 45° to 75°.

In one form of this aspect of the invention, the legs enclose an angle between them of about 60° and the legs and the other broad side substantially form an equilateral triangle.

In another form of this aspect of the invention, the legs lie against each other generally at their heads over about ⅓ of the spacing between the two broad sides.

In yet another form of this aspect of the present invention, the outside of the heat exchanger tube is solder-coated.

In still another form of this aspect of the present invention, there is at least one additional connection between the broad sides formed by a fold in one or the other of the broad sides, wherein the end of the fold is secured to the broad side opposite the one or the other broad side. In a further form, there are a plurality of the additional connections, with the plurality of additional connections being alternately formed from the one broad side and from the other broad side.

In yet another form of this aspect of the present invention, the inner bending radius of the bent edges at the head of the legs is about 0.2 mm.

In still another form of this aspect of the present invention, the thickness of the aluminum strip at the leg head bends is less than the thickness of adjacent portions of the aluminum strip. In a further form, the strip thickness at the leg head bends is about 40% less than the thickness of the adjacent portions of the aluminum strip.

In yet another form of this aspect of the present invention, a method of producing tubes according to this aspect of the invention are provided by rolling adjacent leg bends to have an inner bending radius below 0.2 mm during production of the leg bends whereby the outer bending radius is minimized from the inside out by material displacement.

BRIEF DESCRIPTION OF THE DRAWINGS

The invention is described below in a practical example in conjunction with the illustrations in which.

DETAILED DESCRIPTION OF THE INVENTION

Figure 1:
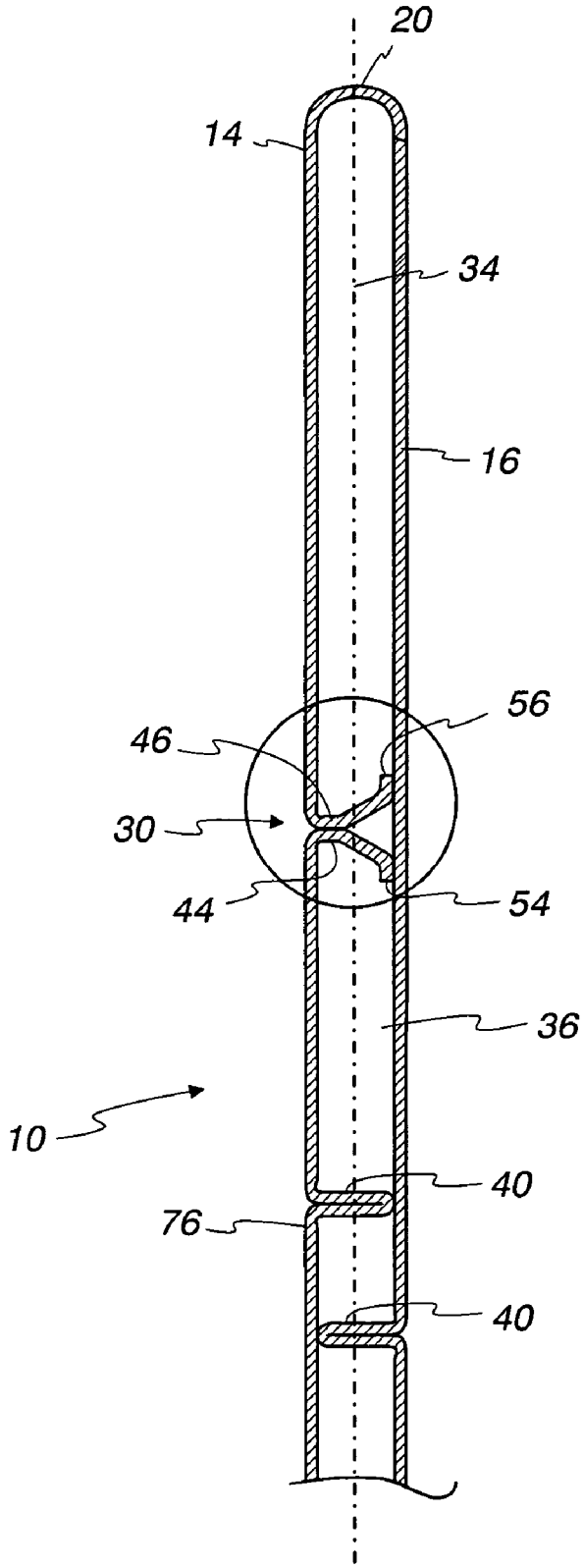
FIG. 1 is a cross-sectional view through a preferred heat exchanger tube according to the invention.

A flat heat exchanger tube 10 according to the present invention is shown in cross-section in the Figures. Such a tube 10 may be advantageously used in a heat exchanger such as is known by those skilled in the art. For example, a plurality of parallel such tubes 10 may be secured between two headers (not shown) to convey a single or two phase fluid between the headers, which fluid may be cooled by a second fluid (such as air) passing over the outside of the tubes 10. Suitable fins (not shown), including serpentine and plate fins, may be provided with the tubes 10 to facilitate heat exchange between the fluid in the tubes 10 and the second fluid, such as generally well known.

In accordance with the present invention, the tube 10 may be advantageously produced from a single deformable sheet strip of limited sheet thickness made of aluminum sheet by means of rollers. When formed as described herein, the tube 10 has two opposite broad sides 14, 16 and two opposite narrow sides 20, 22 (with only one narrow side 22 depicted in FIG. 1, such side being essentially identical to the depicted narrow side 20).

A connection 30 is arranged between the two broad sides 14, 16 and divides the heat exchanger tube 10 into two chambers 34, 36 having the same cross-sectional size when the connection 30 is situated roughly in the center of the two broad sides 14, 16. It would be within the scope of the present invention, however, to locate the connection 30 outside of the center, in which case the chambers 34, 36 could have different cross-sectional sizes. Additional folds 40, discussed in greater detail hereafter, may also be provided to variously subdivide the chambers 34, 36 as desired, whereby more than two chambers 34, 36 may advantageously be produced from a sheet strip solder-coated on both sides in order to advantageously solder the various connections of broad sides 14, 16.

Figure 2:
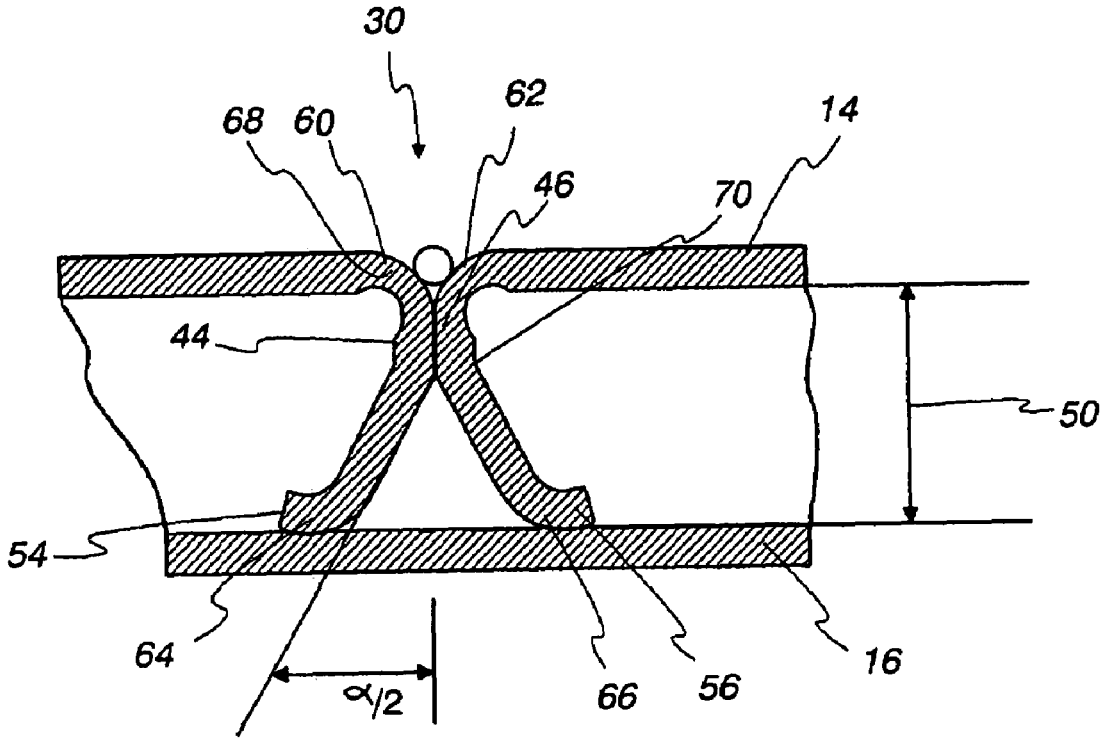
FIG. 2 is an enlarged view cut-out from FIG. 1.

The connection 30 consists of two adjacent legs 44, 46, in which, in the practical example according to FIGS. 1 and 2, the legs 44, 46 are only adjacent to each other over not more than half (and advantageously over about ⅓) of the distance 50 (see FIG. 2) between the two broad sides 14, 16. These adjacent portions of the legs 44, 46 allow for a relatively large connection surface (particularly in comparison with U.S. Pat. No. 6,209,202 B1), leading to a high-quality soldering joint along the length of the tube 10.

The legs 44, 46 are formed from the two longitudinal edges 54, 56 of the heat strip. Each leg 44, 46 has a head 60, 62 and a foot 64, 66, with the heads 60, 62 each consisting of a bend with a small bending radius 68 along one broad side 14. The feet 64, 66 are generally aligned and extend outwardly away one another toward the opposite sides 20, 22, defining aligned flat sides which lie against the other broad side 16, and is preferable secured thereto during manufacture by soldering.

Figure 5:
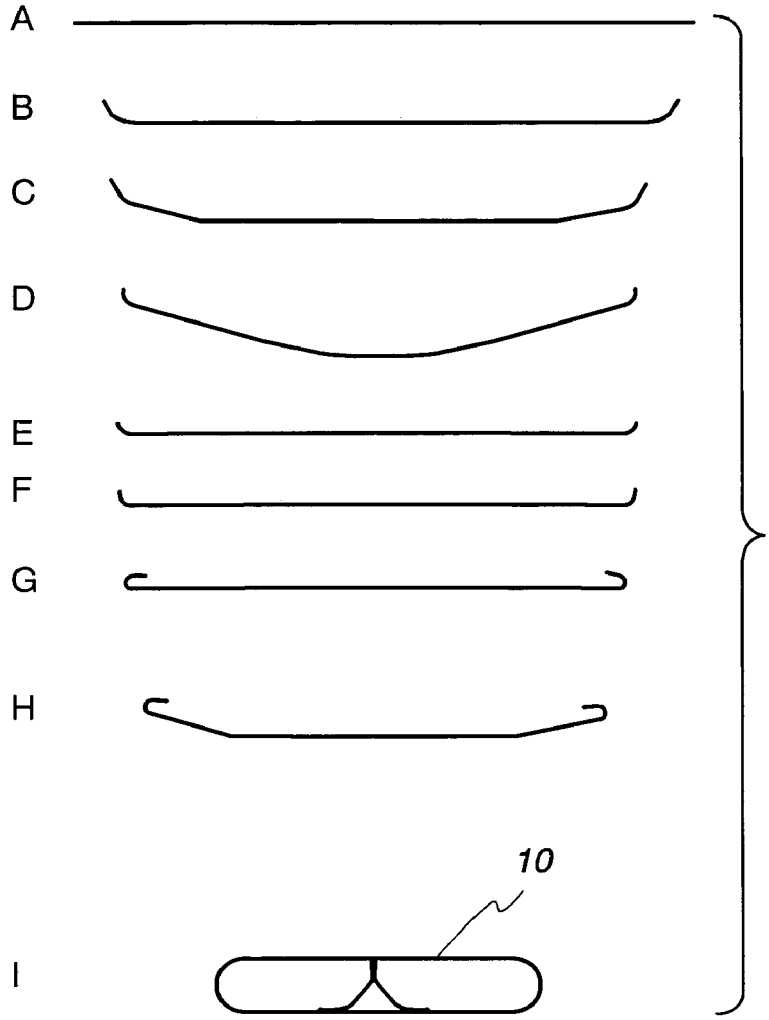
FIG. 5 schematically illustrates the configuration of a sheet strip used to form a heat exchanger tube according to the invention during manufacturing steps A through I.

The sheet thickness of legs 44, 46 is smaller in the region of bending radii 68 than in the other sections of legs 44, 46 so that the connection 30 has its smallest sheet thickness at their heads 60, 62. The reduced sheet thickness may be advantageously produced by rolling the longitudinal direction of the aluminum sheet strip in a first processing step, in which case the sheet thickness of the sheet strip may, for example, be advantageously reduced by about 30%, and as much as about 40% without unacceptably weakening the tube, in the region of bending radii 68. This process step may advantageously occur before production of the bending radii 68, that is, the rollers cause a reduction in sheet thickness on the flat sheet strip as indicated at step A in FIG. 5 (in which eight [steps A to H] of a total of eighteen possible steps to produce a tube as shown at I are indicated schematically). Such deformation may be accomplished by any suitable method including, for example, in succession on an endless sheet strip by a number of cooperating roller pairs (with each roller pair consisting, e.g., of a roller arranged above and below the sheet strip). However, it should be recognized that it would also be within the scope of the present invention to begin at step B and carry out reduction of the sheet thickness simultaneously with production of the bending radii 68.

Moreover, it would be in accordance with some features of the present invention to produce tubes by rolling adjacent leg bends to have a very small inner bending radius (advantageously, e.g., below 0.2 mm) during production of the leg bends whereby the outer bending radius is minimized from the inside out by material displacement.

In step D, bulging of the sheet strip is carried out in order to create a bias of the sheet strip, which helps to prevent collapse of the broad side of the resulting heat exchanger tube 10.

After leaving the unit, the finished heat exchanger tube 10 (I in FIG. 5) is cut to the lengths required for the intended use.

A suitable sheet thickness in one practical example in the region of the bending radii 68 may be, for example, 0.20 mm, as shown in FIG. 2, with a sheet strip otherwise having a thickness of about 0.30 mm.

Part of the spacing a between one broad side 14 and the other broad side 16, in which the legs 44, 46 lie against each other, begins at the heads 60, 62 of legs 44, 46, or in the bending radii 68. The legs 44, 46 are then bent to an angle of about 45° to 75° (advantageously about 60°) relative to the one broad side 14, that is, they have an additional bend 70. This bend 70 forms the site at which the legs 44, 46 may be further spread by loading in a direction perpendicular to broad sides 14, 16, or where they yield and therefore permit tolerance compensation without adversely affecting the connection 30. This bend 70 need not be reduced in sheet thickness, since it does not extend to the outside of the heat exchanger tube because the radius in this bend 70 need not have a specified small value.

It is apparent from FIG. 2 that a roughly equilateral triangle may be formed between legs 44, 46 and the other broad side 16 where the bend angle is about 60°.

The end of the corresponding leg 44, 46 forming the head 14 of legs 44, 46 is bent in the direction toward the narrow sides 20, 22 of the heat exchanger tube, so that the corresponding longitudinal edge 54, 56 has a bent end forming the feet 64, 66 which are supported against the other broad side 16. The bent ends each enclose an angle between roughly 90° and 130° with their legs 44, 46. Once a full understanding is had of the invention, it will be appreciated that by appropriate choice of the length of the bent end and its cross-sectional shape, the quality of the solder connection can be enhanced. Moreover, tolerances in the width of the sheet strip can thus be compensated with the described ends forming the feet 64, 66. Further, the ends may be somewhat rounded off, so that a sufficiently large solder connection surface is produced between the longitudinal edges 54, 56 and broad side 16, on the one hand, while the angle between the legs 44, 46 can be easily spread apart for tolerance compensation on the other hand. The outside of the heat exchanger tube in this practical example may advantageously be solder-coated 76.

In accordance with the present invention, the legs 44, 46 lie against each other only over part of the distance between the broad sides 14, 16 (preferably about ⅓ of that distance) and the legs 44, 46 then separate at an angle of about 45° to 75° (advantageously about 60°), a sufficiently large connection surface is created between the legs 44, 46, on the one hand, and the elasticity of the connection is improved, on the other. This makes it possible to permit greater tolerances in heat exchanger tubes of this design. It should be understood, however, that according to one feature of the invention, the angle ($\alpha$) between legs 44, 46 may more broadly be in the range of about 20° to 100°.

Multiple heat exchanger tubes 10 as described herein may, for example, be stacked together with corrugated ribs or with plate fins, such as is known in the art, to form the so-called rib-tube block or grate of a heat exchanger. The grate may be soldered while loaded with weights in order to keep the entire grate under a certain stress until conclusion of the soldering process to produce high-quality heat exchanger grates. During such process and until the broad sides 14, 16 are flat, a force such as produced by such weights and acting perpendicular to the broad sides 14, 16 could bend the legs 44, 46 (particularly for long legs). Rounding off the ends of the legs 44, 46 such as described support this advantageous effect. That is, if the legs 44, 46 are somewhat too short, the weights can compress the broad sides so that the ends of the legs 44, 46 can nevertheless be soldered to the opposite broad side 16. (It should be kept in mind that the broad sides 14, 16 should not come out too thick. In this respect plus tolerances are more easily compensated than minus tolerances.)

Figure 3:
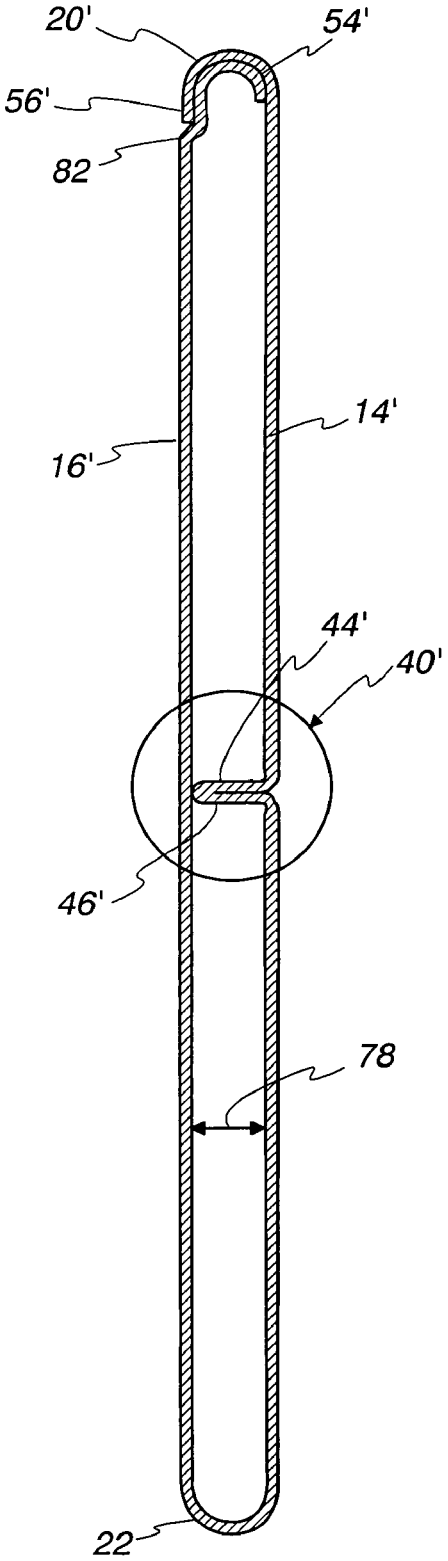
FIG. 3 is a cross-sectional view of another heat exchanger tube.
Figure 4:
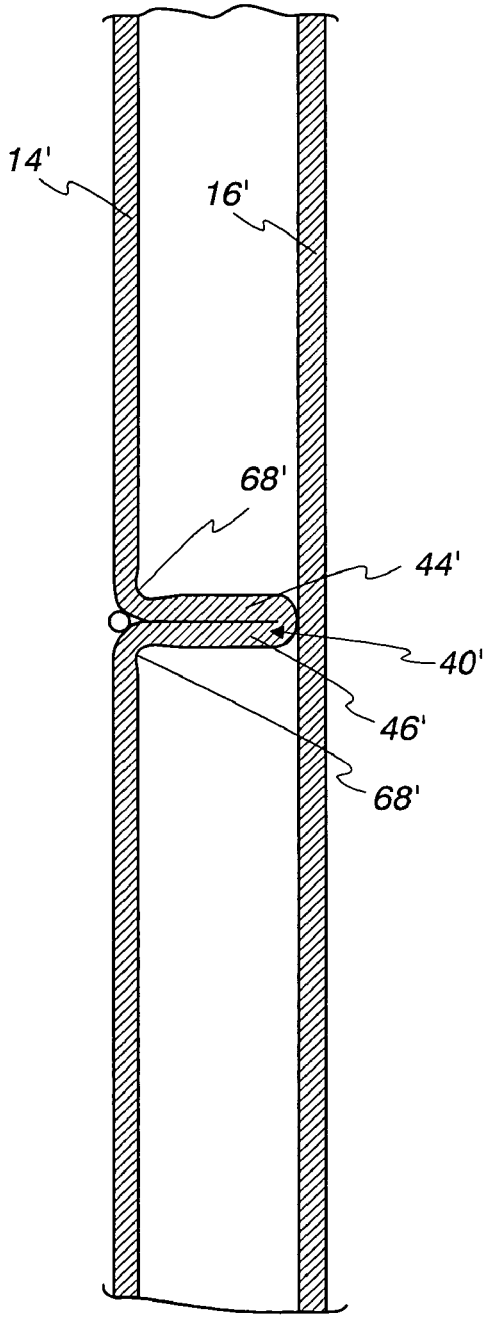
FIG. 4 is an enlarged view cut-out from FIG. 3.

FIGS. 3 and 4 show another embodiment in which the two legs 44', 46' of another connection 30' are formed from a broad side 14' in the fashion of a fold 40'. Such folds 40 can be provided in the described heat exchanger tube according to the invention. The legs 44', 46' lie against each other over substantially the total spacing 80 between one broad side 14' and the other broad side 16'.

The sheet thickness in the region of bending radii 68' may be advantageously initially reduced here by rolling before the bending radii 68' themselves are produced.

The longitudinal edges 54', 56' of the sheet strip are joined together in a narrow side 20' of the heat exchanger tube so that both longitudinal edges 54', 56' are shaped roughly semicircular when viewed in cross-section (see FIG. 3). One longitudinal edge 56' has a larger semicircle than the other longitudinal edge 54' whereby the smaller semicircle fits into the larger semicircle and can be soldered in it. The longitudinal edge 54' with the smaller semicircle has a bend 82 toward the tube interior, with the size of the bend 82 corresponding roughly to the sheet strip thickness.

A smaller sheet thickness is present in bending radius 68' of this bend 82 than in the adjacent sections of longitudinal edge 54' of the strip. This bend 82 can also be produced by initially reducing the sheet thickness in bending radius 68' and then producing bend 82 itself. This means, as shown in FIG. 3, that the size of the "free cut" on the outside of the heat exchanger tube, where the two longitudinal edges 54', 56' meet, is minimized. Such small cylinders, shown as holes, are easily sealed during soldering of the ends of the heat exchanger tubes in the openings of the tube plate.

The embodiment shown in FIG. 4 has a connection 30', which, as already mentioned, is formed from the broad side 14' of the heat exchanger tube. In order to create a relatively small opening that is easily soldered by soldering to a tube plate toward the outside of the heat exchanger tube, the sheet thickness may also be advantageously reduced in the tube bending radii 68' there in the first manufacturing step before the bending radii 68' themselves were produced.

It should be recognized that the connection 30 according to the invention constructed from two longitudinal edges 54, 56 as shown in FIGS. 1-2 may be advantageously combined with additional connections (folds 40) as illustrated in detail at 40' in FIGS. 3-4. It should further be understood that such folds 40, 40' may alternately be formed from one broad side 14 then the other broad side 16. Two alternating folds 40 are shown in FIG. 1 as an example illustrating such a structure.

At least one side of the sheet strip is solder-coated, namely the outside of the heat exchanger tube 10. However, sheet strips may be advantageously solder-coated on both sides (if, e.g., other connections formed from a single broad side are provided between the broad sides to divide the heat exchanger tube into more than two chambers as previously described).

Figure 6:
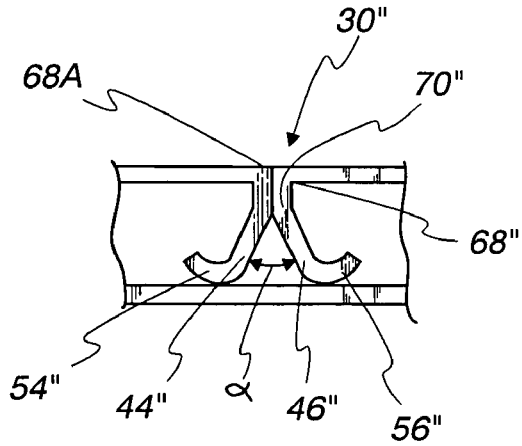
FIG. 6 is an enlarged view cut-out from another heat exchanger tube according to the present invention.

In FIG. 6 the connection 30" of a heat exchanger tube is shown in which the sheet thickness is not reduced in the bending radii 68". An inner bending radius of less than 0.2 mm may advantageously be produced there by rolling, with the aluminum shifted or displaced in the direction toward the outer bending radius 68*a* which, as a result, is very small. In this practical example as well, the second bend 70" is provided in the legs 44", 46", which is significant for tolerance compensation and for the elasticity of the connection 30". The end of longitudinal edge 54" or 56" may be shaped roughly semicircular so that tolerance compensation is supported.

It should thus be appreciated that heat exchanger tubes according to the present invention having such small bend radii 68 so that tight soldering of the tube ends is possible without problems which could otherwise between the outer periphery of such tubes 10 and tube plates, whereby admissible manufacturing tolerances may be increased.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A flat heat exchanger tube formed of a single strip of rolled aluminum, said tube comprising:

two opposite spaced apart broad sides and two opposite narrow sides; and at least one connection between the two broad sides, said connection being generally parallel to and spaced between said narrow sides and dividing the heat exchanger tube into at least two chambers, and including two legs consisting of bent opposite edges of the aluminum strip, said legs having first bends along one of the broad sides, second bends between the broad sides, and third bends defining feet extending from the legs adjacent the other broad side, wherein an oblique angle is defined between each leg and foot extending therefrom, wherein said legs lie against each other between the first and second bends over no more than half of the entire spacing between the two broad sides, and said feet define substantially flat surfaces secured to said other broad side.

2. The heat exchanger tube of claim 1, wherein said legs enclose an angle between them of about 20° to 100°.

3. The heat exchanger tube of claim 1, wherein said legs enclose an angle between them of about 45° to 75°.

4. The heat exchanger tube of claim 3, wherein said legs enclose an angle between them of about 60° and said legs and said other broad side substantially form an equilateral triangle.

5. The heat exchanger tube of claim 3, wherein said feet are substantially aligned and extend in opposite directions from said legs.

6. The heat exchanger tube of claim 1, wherein said legs lie against each other between the first and second bends over about ⅓ of the spacing between the two broad sides.

7. The heat exchanger tube of claim 1, wherein said feet are substantially aligned and extend in opposite directions from said legs.

8. The heat exchanger tube of claim 1, wherein the outside of the heat exchanger tube is solder-coated.

9. The heat exchanger tube of claim 1, further comprising at least one additional connection between said broad sides formed by a fold in one or the other of the broad sides, wherein the end of the fold is secured to the broad side opposite said one or the other broad side.

10. The heat exchanger tube of claim 9, wherein there are a plurality of said additional connections, said plurality of additional connections being alternately formed from said one broad side and from said other broad side.

11. The heat exchanger tube of claim 1, wherein the inner bending radius of the first bends is about 0.2 mm.

12. The heat exchanger tube of claim 1, wherein the thickness of the aluminum strip at the first bends is less than the thickness of adjacent portions of the aluminum strip.

13. The heat exchanger tube of claim 12, wherein said strip thickness at the first bends is about 40% less than the thickness of said adjacent portions of the aluminum strip.

14. A method of producing a flat heat exchanger tube according to claim 1, wherein said first bends have an inner bending radius which is rolled to a value below 0.2 mm during production of the first bends whereby the outer bending radius is minimized from the inside out by material displacement.

15. A flat heat exchanger tube formed of a single strip of rolled aluminum, said tube comprising:

two opposite spaced apart broad sides and two opposite narrow sides; and at least one connection between the two broad sides, said connection being generally parallel to and spaced between said narrow sides and dividing the heat exchanger tube into at least two chambers, and including two legs consisting of bent opposite edges of the aluminum strip, said legs having first bends along one of the broad sides, second bends between the broad sides, and third bends defining feet extending from the legs adjacent the other broad side, wherein an oblique angle is defined between each leg and foot extending therefrom;

wherein said legs lie against each other between the first and second bends over no more than half of the entire spacing between the two broad sides, and enclose an angle between them of about 45° to 75°.

16. The heat exchanger tube of claim 15, wherein said legs enclose an angle between them of about 60° and said legs and said other broad side substantially form an equilateral triangle.

17. The heat exchanger tube of claim 15, wherein said legs lie against each other between the first and second bends over about ⅓ of the spacing between the two broad sides.

18. The heat exchanger tube of claim 15, wherein the outside of the heat exchanger tube is solder-coated.

19. The heat exchanger tube of claim 15, further comprising at least one additional connection between said broad sides formed by a fold in one or the other of the broad sides, wherein the end of the fold is secured to the broad side opposite said one or the other broad side.

20. The heat exchanger tube of claim 19, wherein there are a plurality of said additional connections, said plurality of additional connections being alternately formed from said one broad side and from said other broad side.

21. The heat exchanger tube of claim 15, wherein the inner bending radius of the first bends is about 0.2 mm.

22. The heat exchanger tube of claim 15, wherein the thickness of the aluminum strip at the first bends is less than the thickness of adjacent portions of the aluminum strip.

23. The heat exchanger tube of claim 22, wherein said strip thickness at the first bends is about 40% less than the thickness of said adjacent portions of the aluminum strip.

24. A method of producing a flat heat exchanger tube according to claim 15, wherein said first bends have an inner bending radius which is rolled to a value below 0.2 mm during production of the first bends whereby the outer bending radius is minimized from the inside out by material displacement.

* * * * *

UNITED STATES PATENT AND TRADEMARK OFFICE

CERTIFICATE OF CORRECTION

PATENT NO. : 7,665,512 B2
APPLICATION NO. : 10/865291
DATED : February 23, 2010
INVENTOR(S) : Brost et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 460 days.

Signed and Sealed this

Seventh Day of December, 2010

David J. Kappos

David J. Kappos
*Director of the United States Patent and Trademark Office*